US005746009A

United States Patent [19]

Brugger

[11] Patent Number: 5,746,009

[45] Date of Patent: May 5, 1998

[54] TEMPERATURE CONTROL IN A PAPER MACHINE DRYER

[75] Inventor: Hubert Brugger, Bergatreute, Germany

[73] Assignee: Voith Sulzer Papiermaschinen GmbH, Germany

[21] Appl. No.: 768,220

[22] Filed: Dec. 17, 1996

Related U.S. Application Data

[63] Continuation-in-part of Ser. No. 635,763, Apr. 22, 1996.

[51] Int. Cl.[6] ..... F26B 3/00

[52] U.S. Cl. ..... 34/446; 34/454

[58] Field of Search ..... 34/445, 446, 449, 34/495, 497, 521, 452, 454

[56] References Cited

U.S. PATENT DOCUMENTS

| | | | |
|---|---|---|---|
| 2,879,039 | 3/1959 | Skinner . | |
| 3,363,325 | 1/1968 | Schie | 34/446 |
| 3,675,337 | 7/1972 | Daane | 34/454 |
| 3,869,808 | 3/1975 | Sawyer | 34/124 |
| 4,089,121 | 5/1978 | Sawyer | 34/452 |
| 4,493,158 | 1/1985 | Van Os | 34/454 |

*Primary Examiner*—Henry A. Bennett
*Assistant Examiner*—Steve Gravini
*Attorney, Agent, or Firm*—Ostrolenk, Faber, Gerb & Soffen, LLP

[57] ABSTRACT

A process and apparatus for controlling the surface temperature of a drying cylinder of a paper machine, in which air may be admixed with the steam introduced into the drying cylinder to adjust the partial steam pressure. The mixture ratio of air and steam is controlled as a function of the measured temperature of the mixture discharging from the drying cylinder. Also, pressure measurements are made of the pressure in the infeed and discharge lines of the cylinder, and valves control this dependent on the measurements. The valves are controlled to provide all steam to the cylinder above a predetermined minimum pressure in the cylinder below 1 bar and to provide a mix of air and steam below the predetermined minimum pressure. Arrangements for controlling one cylinder at a time, several cylinders together for supply of both steam and air, or several cylinders for controlling respective separate supplies of air and with one supply of steam are disclosed.

17 Claims, 3 Drawing Sheets

TEMPERATURE CONTROL IN A PAPER MACHINE DRYER

CROSS-REFERENCE TO RELATED APPLICATION

This is a continuation-in-part of application Ser. No. 08/635,763, filed Apr. 22, 1996.

BACKGROUND OF THE INVENTION

The present invention relates to a process for controlling the temperature at the paper web contacting surface of a drying cylinder of a paper machine, particularly using controlled mixing of air with the steam being introduced into the drying cylinder, and the invention relates to a device for carrying out this process.

Traditional paper machines include a drying section in which steam filled drying cylinders are arranged in at least one drying group. The web of paper is guided in a meandering path through the drying section, with the web guided to come into surface contact serially with individual drying cylinders. In order to heat the web of paper during this contact with the surfaces of the cylinders and thus dry the web, the inside of each drying cylinder is filled with steam which heats the surface of the cylinder. The quality of paper which can be produced depends decisively on providing uniform heating of each cylinder surface with respective internal cylinder temperatures which can be selected in advance.

Several considerations enter into selecting the cylinder temperatures for different cylinders. Some papers should be dried at lower dryer surface temperatures, such as some thermographic, thermal or heat activated papers. They should be contacted for example, by a cylinder surface temperature significantly below 100° C. Also, as a moist paper web first enters a drying section, it should not be shocked by initially contacting a too hot dryer surface, and the web should first be warmed before being exposed to a high dryer temperature. It is conventional to progressively increase the surface temperatures of successive dryers in a drying section through use of different heating groups, each with their dryers holding steam at different pressures, on the web path through the drying section.

A desired temperature of the drying cylinder is obtained, for instance, by suitable adjustment of the steam pressure within the drying cylinder. The higher is the steam pressure, the higher is the temperature of condensation of the steam, so the hotter is the drying cylinder dry surface. At atmospheric pressure of 1 bar absolute, the condensation temperature is 100° C. Generally, at a cylinder pressure of 0.6 bar absolute, the condensation temperature may be about 86° C., and at a cylinder pressure of 0.2 bar absolute, the condensation temperature may be about 60° C. These numbers apply when the cylinder is supplied with steam only. As a result, there is a negative pressure in some cylinders. To greatly reduce steam pressure below atmospheric pressure in a cylinder is both difficult and expensive. Another technique for reducing the condensation temperature in a drying cylinder is needed.

The prior art also contemplates feeding a mixture of air and steam to the drying cylinder. This permits the cylinder pressure to be near, at or above atmospheric pressure, avoiding the problems of reducing cylinder pressure. The air admixed reduces the partial pressure of the steam in the cylinder and, accordingly, reduces the condensation temperature of the steam. This has a direct effect on the temperature conditions in the drying cylinder and particularly at the surface of the cylinder which is wrapped over by the paper web. The amount and proportion of air to steam fed is manually adjusted as a function of the measured amount of air. As a result, the condensation temperature can be reduced below 100° C. But manual adjustment has the disadvantages of being cumbersome and rapid changes in the temperature conditions within the drying cylinder cannot be reacted to sufficiently rapidly.

SUMMARY OF THE INVENTION

The objects of the present invention are to provide a process for adjusting the drying power of a drying cylinder and an apparatus for carrying out this process, which avoid the above indicated disadvantages.

The invention deals with two different conditions. If the steam pressure in the cylinder is above a minimum value, then it is acceptable to govern the cylinder pressure only by manipulating the steam pressure into the cylinder. But if the cylinder pressure is below the minimum value, then a different process is needed for controlling a supply of air to the steam to maintain cylinder pressure and achieve a desired temperature. The invention concerns obtaining the desirable cylinder temperature under both pressure conditions.

In the invention, the amount of air mixed with the steam is controlled as a function of the temperature of the air-steam and condensate mixture that emerges from an exit from the drying cylinder. That temperature is deemed equivalent to the condensation temperature of the steam in the cylinder. If the temperature is too high, the amount of air is increased, and vice versa. This makes adjustment of the desired temperature conditions in the drying cylinder easy to accomplish directly and in a controlled fashion.

The process involving controlling air supply to the steam commences when the pressure prevailing in the drying cylinder has a predetermined value which is less than 1 bar, preferably between 0.2 and 0.97 bar, and in particular between 0.7 and 0.9 bar. Within this operating pressure range, the condensation temperature of the steam in the cylinder is below 100° C. The minimum pressure level is selected at least in part based on the lowest pressure level that can be reasonably conveniently achieved in the cylinder without excessive effort or expense.

Above the minimum pressure level, control over the air supply is not required. Therefore, in a further development of the invention, the control process is no longer used when the pressure in the drying cylinder is above the predetermined minimum pressure. Control of the pressure in the drying cylinder then takes place by adjusting only the steam pressure, and in that connection, the feed of air is completely interrupted.

Other objects and features of the present invention are now explained with reference to the accompanying drawings.

DESCRIPTION OF THE PREFERRED EMBODIMENTS

Figure 1:
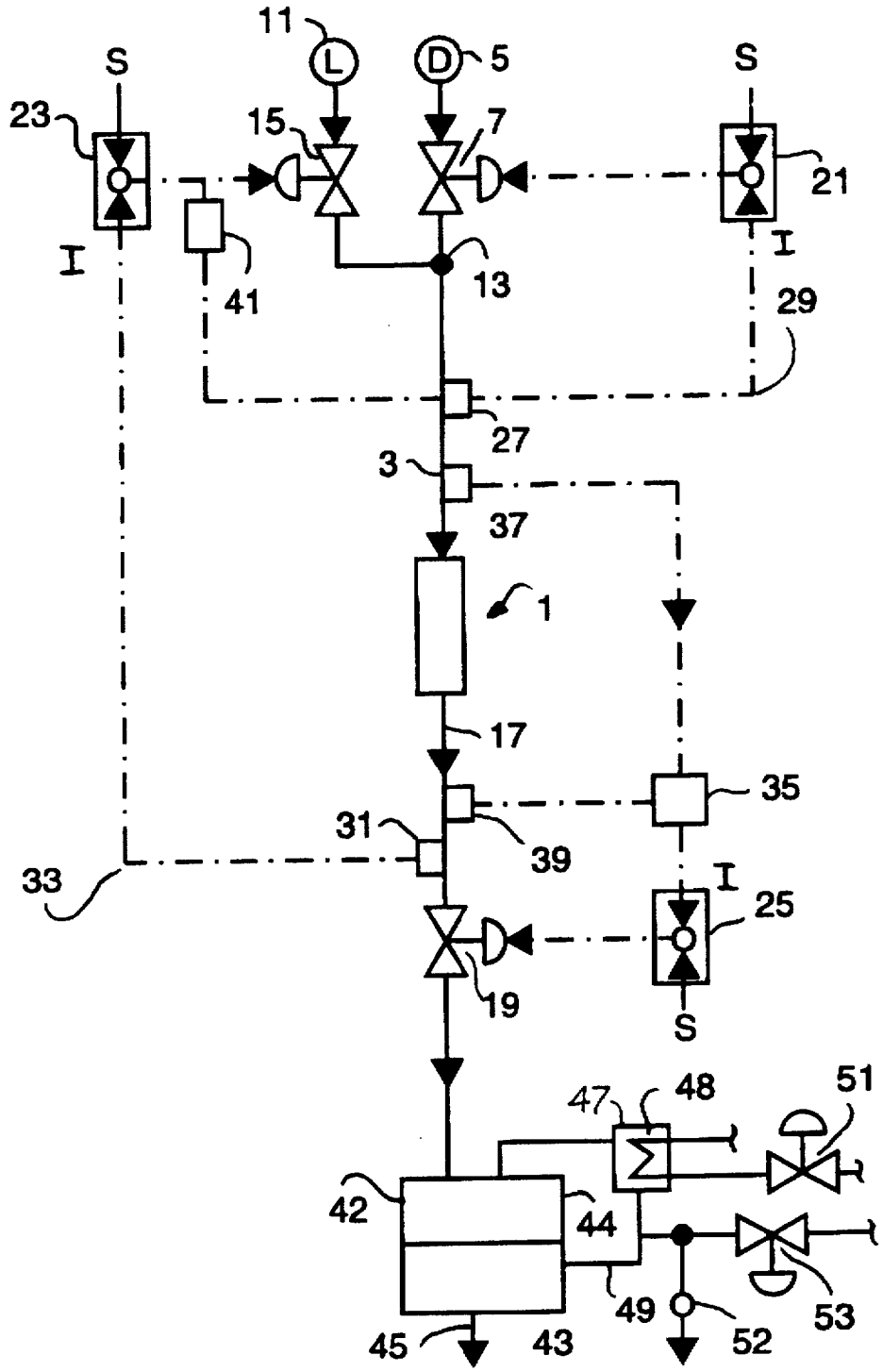
FIG. 1 is a diagrammatic block diagram of a drying cylinder with its corresponding lines and control devices for practicing the invention.

FIG. 1 diagrammatically shows one drying cylinder 1 which is part of a drying group that is typically comprised of several drying cylinders, and the drying group is part of a drying section that is typically comprised of several drying groups, although the invention is not concerned with the quantities of either the cylinders or the drying groups. The drying cylinder 1 is an enclosed steel drum which is connected via a steam feed line 3 to a source of fresh steam 5 for filling the inside of the drying cylinder with steam and for continuously delivering fresh steam to the cylinder. A controllable valve 7 in the feed line 3 controls the stream of steam to the cylinder.

An air supply line 9 discharges into the feed line 3 downstream of the valve 7 along the steam entry path. The other end of the line 9 is connected to a source of air 11 which is to be admixed with the stream of steam at the outlet point 13 from the line 9. Because the air is mixed with steam only when the total cylinder pressure is below a minimum level, the air source need not be pressurized but may be a connection to air at atmospheric pressure.

There is another valve 15 in the line 9 for adjusting the stream of air.

In addition, a non-return valve (not shown) in the line 9 prevents the steam from flowing back toward the source of air.

The drying cylinder 1 is further connected to a discharge line 17 through which the steam present within the cylinder can escape as so called slippage steam together with condensate that forms in the cylinders and air, together called mass flux. Another valve 19 is also provided in the discharge line 17.

Each of the valves 7 for steam inlet, 15 for air inlet, and 19 for steam discharge is connected to a respective automatically operated control member 21, 23, and 25, which causes the opening and closing of the respective valves as a function of adjustable, measured parameters.

Ordinarily, each control member 21, 23, 25 is fed with a desired value S, which can for instance be introduced from the outside, and an actual value I. The goal is to have each actual value I approach its respective desired value S.

A pressure measuring means 27 measures the absolute pressure value $p_z$ in the feed line 3 which is or is approximately the absolute pressure $p_z$ in the cylinder. The means 27 supplies the pressure $p_z$ as an actual value to the control member 21 for the valve 7 via a corresponding line 29.

A temperature measurement means 31 is associated with the discharge line 17 to measure the temperature of the mass flux comprised of a mixture of slippage steam, condensate and air leaving the cylinder. That temperature is or is approximately the temperature of the condensing steam in the cylinder. The object of the invention is to achieve the desired temperature at means 31. The actual value for the control member 23 for the valve 15 is supplied by the temperature measurement means 31 via a signal transmission line 33 to the control member 23. That control member 23 opens the valve 15 to permit more air to be mixed with steam when the condensation temperature is too high.

A sufficient pressure difference is required between the inlet 3 and outlet 17 lines to the cylinder in order to achieve uniform temperature and continuously expel condensate which forms. On the other hand, if the pressure difference between the feed and discharge lines is too high, too much steam is being discharged from the cylinder, which is wasteful of energy. The control member 25 for the discharge valve 19 receives as its actual value I a pressure difference value from the pressure difference former 35. The input signals for the pressure difference former 35 are delivered, on the one hand, by another pressure measurement means 37, which is associated with the mixed steam and air feed line 3 and, on the other hand, by a pressure measurement means 39 which is associated with the discharge line 17. The pressure difference former 35 then calculates the pressure difference between the feed and the discharge lines to and from the drying cylinder 1 and feeds that to the control member 25. The control member 25 opens the valve 19 to increase the pressure difference if its actual value I is below its ideal value S and closes the valve 19 if the actual pressure difference is above its ideal value.

The principle of the control over the drying power of the drying cylinder is now described.

Depending on the absolute pressure $p_z$ in the drying cylinder 1, as measured by means 27, one of two different types of control is selected. For this purpose, the actual pressure $p_z$ is compared at control device 41 with a fixed or adjustable minimum pressure $p_{min}$, e.g. a pressure which is less than 1 bar, preferably between 0.2 and 0.97 bar, and particularly between 0.7 to 0.9 bar that is stored in device 41.

If the internal pressure $p_z$ of the drying cylinder is above the minimum pressure $p_{min}$, then the drying capacity of the drying cylinder 1, obtained by the condensation temperature in the cylinder, is varied only via the steam pressure control 7,21. In this case, the air valve 15 is first completely closed by action of the control device 41 so that no air is admixed with the stream of steam. The actual steam pressure I in the feed line 3 is noted by the pressure measurement means 27 and is compared with a desired value S in the control member 21. If the actual steam pressure value differs from the desired value, the valve 7 is adjusted accordingly to bring the values together. Since changing the steam pressure can also change the condensation temperature in the same direction, the temperature conditions in the drying cylinder 1 can be adjusted in the desired manner. Regardless of the amount of steam fed to the drying cylinder, the control member 25 maintains the pressure difference between the feed and discharge lines of the drying cylinder 1 constant through operating the discharge valve 19.

If the pressure $p_z$ in the drying cylinder 1, measured as described above, is less than 1 bar and if it corresponds to the minimum pressure $p_{min}$, switching is effected by the control device 41 to the second type of control. The air valve 15 is now controlled by the control member 23. In this case, the temperature conditions are no longer controlled solely by adjustment of the stream of steam but also by admixing air in the stream of steam. The admixing of air reduces the partial vapor pressure of the steam in the cylinder and, accordingly, reduces the condensation temperature without requiring excessive reduction of the absolute pressure in the cylinder.

The valve 15 in the air feed the line 9 adjusts the admixed amount of air, and the control member 23 to that line gives the corresponding control signal to the valve 15.

If the actual value signal I measured at means 31, which corresponds to the temperature of the mixture flowing through the discharge line 17 and thus to the temperature in the cylinder, exceeds the predeterminable desired temperature S, the discharging mixture and therefore the temperature in the cylinder is too hot, and the control member 23 operates the valve 15 to increase the amount of air to the feed line 3. If the measured temperature of the discharging mixture, however, is too low, then the control member 23 operates the valve 15 to reduce the amount of air, causing an increase of the partial pressure of and therefore of the condensation temperature and of the temperature of the discharging mixture.

Both of the control methods indicated above are beneficially used in the manufacture of thermal paper, which is often better produced using low drying cylinder temperatures, but they can be used for manufacturing any type of paper. The methods are also beneficial for use on the earlier cylinders along the web path of a drying section, where reduced temperatures may avoid heat shocking the web.

For more completeness, other elements of the drying cylinder are now described, although they are not directly tied to the methods above described or to the elements which perform the methods.

The steam, air, gas and condensate mixture from the discharge line 19 passes through a separator 42 which includes a condensate collection area 43 and a steam and gas chamber 44 above. Condensate is collected from outlet line 45 for likely reuse. Steam from chamber 44 passes through line 46 and through condenser 47, wherein the cooling coil 48 condenses the remaining steam. The resulting condensate is returned to separator 42 through line 49. The temperature of coil 48 is set by the valve 51 which controls coolant flow. Air and gases continuously passing out the discharge line 19 and which do not condense may be trapped in the illustrated closed system. They are exhausted by the vacuum pump 52 which draws them out of the system and the valve 53 may supply leakage air so as to regulate the vacuum level generated in the closed system by the pump 52.

Figure 2:
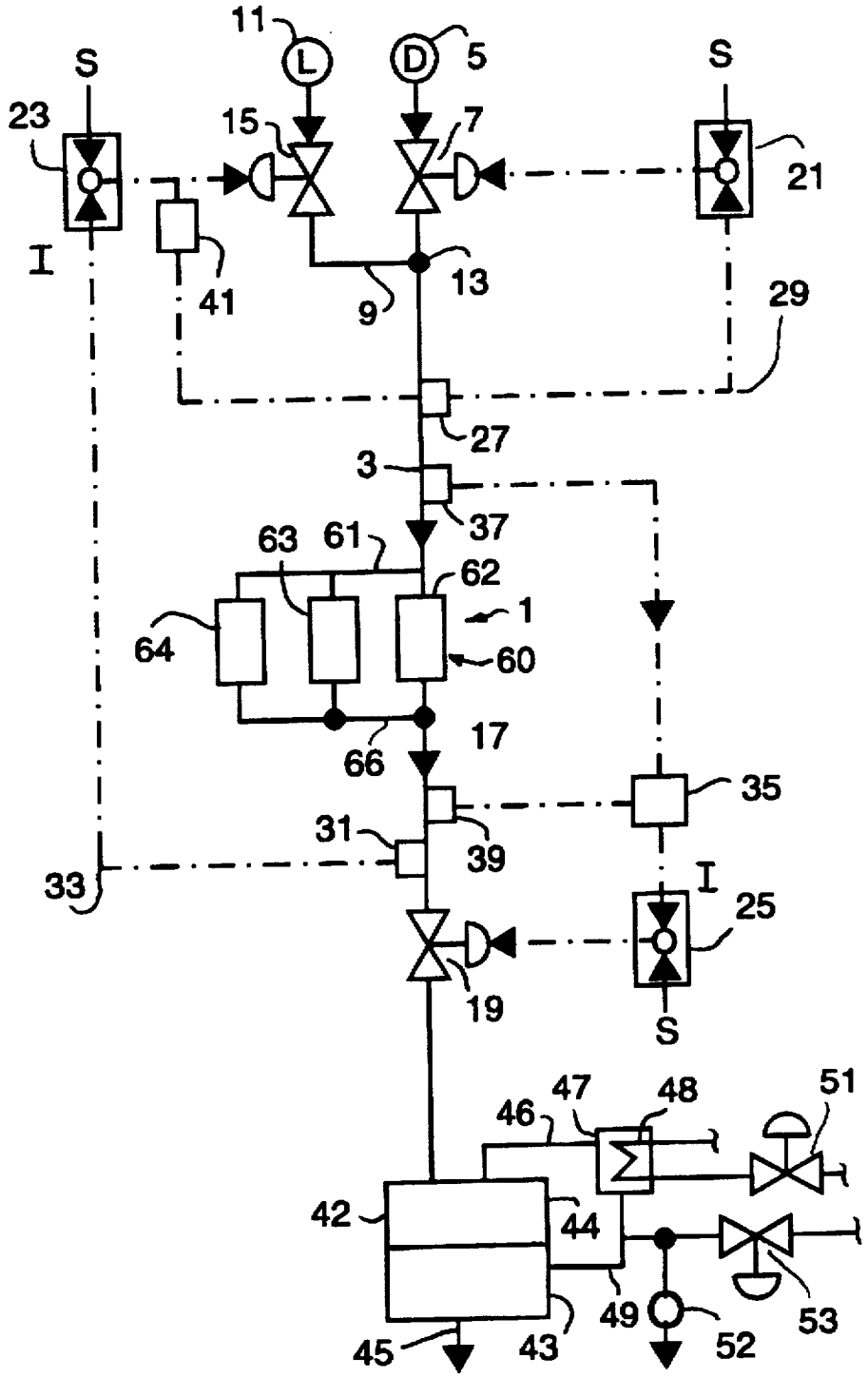
FIG. 2 shows a fragment of a second embodiment, the remainder thereof being the same as in FIG. 1 except that several drying cylinders are supplied together.

FIG. 2 has the same structure as FIG. 1 and operates in the same way, except that instead of the feed line 3 which delivering steam only to a single drying cylinder 1 as in FIG. 1, the feed line 3 delivers steam to a plurality of the drying cylinders arranged in a parallel circuit 60 having a common inlet line 61 from the steam feed line 3 and communicating into each of the plurality of drying cylinders 62, 63, 64, et al. and a common outlet line 66 from the cylinders and leading into the discharge line 17. All of the cylinders 62, 63, 64, et al., receive steam at the same temperature and pressure, possibly combined with air, as described in the first embodiment. Since there is a parallel circuit with several cylinders, a greater volume of steam must be supplied to the line 3 and a correspondingly adjusted volume of air must be supplied to the line 9 when air is mixed with the steam according to the invention. Conditions of temperature, other operating conditions, and all other elements of the arrangement of FIG. 2, would be the same as FIG. 1.

Figure 3:
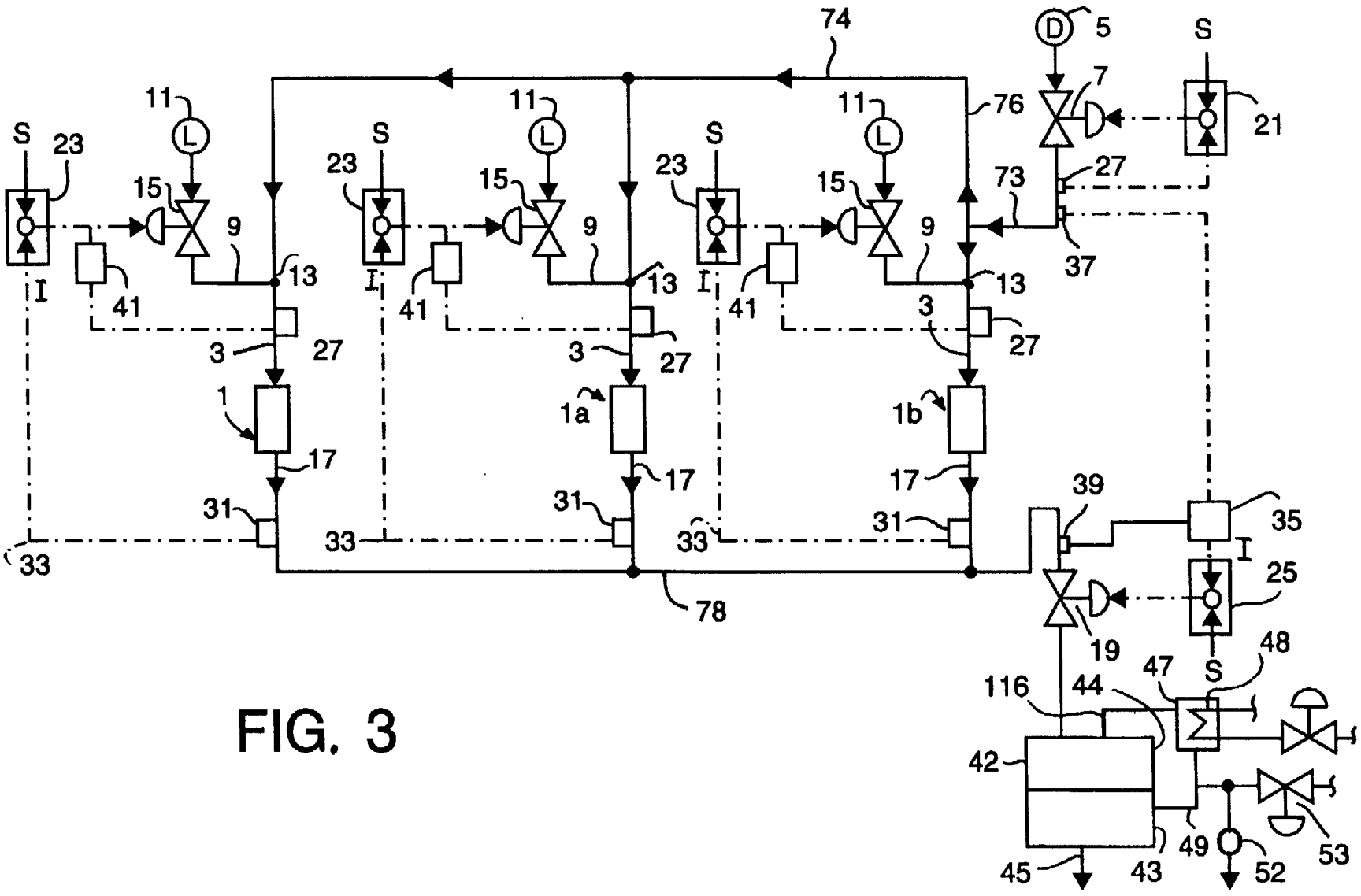
FIG. 3 is a diagrammatic block diagram of a third embodiment showing several drying cylinders arranged in parallel.

The embodiment of FIG. 3 includes a plurality of the arrangements of FIG. 1, all supplied from one steam source 5. Each drying cylinder, 1, 1A, 1B, et al., has its own controls for the outlet temperature of the mass flux from the cylinder. With this arrangement, there is a single supply of steam delivered from the steam source 5 through the single steam valve 7 past the common pressure measuring means 27 which indicates the pressure in all cylinders, which should be the same pressure, past the common pressure measuring means 37 to the common steam inlet line 73. This leads to a common steam feed line 74 to all of the drying cylinders 1, 1A, 1B, et al. and respective branch lines 76 to each of those cylinders. Each branch line is joined with a respective air supply line 9 at an outlet point 13 from the respective air supply line 9. Thereafter, control of the steam flow to each drying cylinder is the same as in FIG. 1. However, the temperature of each cylinder 1, 1A, 1 is independently controlled, since each cylinder has one of the same respective air control valves, etc.

After steam has passed through each of the cylinders 1, 1A, 1B, etc., it passes through respective discharge lines 17 from the cylinders, where the mass flux temperatures are measured at respective measuring means 31, into the common outlet line 78. That common line 78 passes into a common pressure measurement means 39 of the type described in connection with FIG. 1. Therefore, there is a commonly controlled inlet of steam to all of the drying cylinders past the single pressure measurement means 37, and a common outlet of steam from the drying cylinders past the pressure measurement means 39. The pressure difference between the pressure measurement means 37 and 39 determines the pressure drop across all of the cylinders. That pressure difference is sensed by the single pressure difference former 35, which receives measurements from the means 37 and 39, calculates the pressure difference and feeds that to the control member 25.

Furthermore, as in the first embodiment, there is a respective control device 41 at each cylinder, which operates the respective air valve 15 for each cylinder, as described for the first embodiment, whereby the partial pressure of each cylinder is independently adjustable. The second embodiment in FIG. 2 has one such control device 41 so that independent adjustment of the partial pressure in each cylinder is not obtainable. Steam to all of the cylinders is commonly supplied and commonly adjusted. In contrast, the air flow to each of the cylinders is independently controlled, thereby enabling independent control of the partial steam pressure in and the temperature of each cylinder as a result of the selected mixture of steam and air in each of the cylinders. With the arrangement in FIG. 3, the different cylinders may be given different selected partial steam pressure values and therefore different temperatures, by appropriate individual adjustment of the cylinders. In FIG. 2, in contrast, such independent control of different cylinders is not possible.

In other respects, the embodiment of FIG. 3 corresponds to and operates in the same manner as that of FIG. 1 and no further description is supplied of other elements, therefore.

Although the present invention has been described in relation to a particular embodiments thereof, many other variations and modifications and other uses will become apparent to those skilled in the art. It is preferred, therefore, that the present invention be limited not by the specific disclosure herein, but only by the appended claims.

What is claimed is:

1. A process for controlling the temperature at the surface of a drying cylinder and thereby its drying rate by controlling the temperature of the mass flux, including steam, air and condensate, exiting the cylinder, wherein the cylinder is hollow and is heated by steam supplied to the hollow of the cylinder, the process comprising:

introducing steam into the hollow inside the cylinder;

selectively mixing air into the steam being introduced into the drying cylinder such that the absolute pressure in the cylinder includes the partial pressures of the steam and the air;

indirectly measuring the condensation temperature in the cylinder by measuring the temperature of the mass flux exiting the cylinder; and controlling the mixture ratio of air and steam that are introduced into the cylinder by adjusting the amount of air mixed into the steam for controlling the partial pressure of the steam for attaining a desired condensation temperature as a function of the measured temperature of the mass flux exiting the drying cylinder.

2. The process of claim 1, further comprising measuring the pressure in the drying cylinder;

mixing air in controlled fashion in the steam when the pressure ($p_z$) as measured in the drying cylinder corresponds to a predetermined minimum value ($p_{min}$).

3. The process of claim 2, further comprising interrupting the mixing of air in the steam and attaining a desired condensation temperature by controlling the pressure in the drying cylinder when the pressure ($p_z$) in the drying cylinder is greater than the predetermined minimum value ($p_{min}$).

4. The process of claim 3, wherein the predetermined minimum value ($p_{min}$) is less than 1 bar.

5. The process of claim 4, wherein the predetermined minimum value ($p_{min}$) is in the range of 0.2 to 0.97 bar.

6. The process of claim 4, wherein the predetermined minimum value ($p_{min}$) is in the range of 0.7 to 0.9 bar.

7. The process of claim 4, wherein the pressure in the drying cylinder is measured in the inlet to the drying cylinder.

8. The process of claim 4, further comprising interrupting the mixing of air in the steam and attaining a desired condensation temperature by controlling the pressure in the drying cylinder when the pressure ($p_z$) in the drying cylinder is greater than the predetermined minimum value ($p_{min}$).

9. The process of claim 2, wherein the condensation temperature in the cylinder is indirectly measured by measuring the mixture of materials in the mass flux discharging from the cylinder.

10. The process of claim 1, wherein the pressure in the drying cylinder is measured in the inlet to the drying cylinder.

11. The process of claim 1, wherein the drying cylinder is a drying cylinder in the drying section of a paper machine.

12. A process for controlling the temperature at the surface of each of a plurality of drying cylinders and thereby the respective drying rates of the cylinders by controlling the temperature of the mass flux, including steam, air and condensate, exiting each cylinder, wherein each cylinder is hollow and is heated by steam supplied to the hollow of the cylinder, the process comprising:

introducing steam into the hollow inside each cylinder;

selectively mixing air into the steam being introduced into the drying cylinders, such that the absolute pressure in each cylinder includes the partial pressures of the steam and the air therein;

indirectly measuring the condensation temperature in each cylinder by measuring the temperature of the mass flux exiting the cylinders; and controlling the mixture ratio of air and steam that are introduced into all of the cylinders by adjusting the amount of air mixed into the steam for controlling the partial pressure of the steam in each cylinder for attaining a desired condensation temperature as a function of the measured temperature of the mass flux exiting the drying cylinders.

13. The process of claim 12, further comprising the introducing of steam or of steam and air comprises introducing the same ratio of steam with air or of steam without air simultaneously to all of the cylinders.

14. The process of claim 13, wherein the measuring of the temperature of the mass flux is done in one measurement for all of the cylinders.

15. The process of claim 14, wherein the measuring of the temperature of the mass flux is done in one measurement for all of the cylinders.

16. The process of claim 13, wherein the introducing of steam to all of the cylinders is at a constant pressure, whereas the ratio of air to steam introduced to each cylinder is individually controlled.

17. The process of claim 13, wherein the measuring of the temperature of the mass flux is done in a respective measurement for each of the cylinders and the ratio of air to steam to each cylinder is adjusted by adjusting the respective pressure of air to each cylinder.

* * * * *